US005366219A

United States Patent [19]

Salcer et al.

[11] Patent Number: 5,366,219

[45] Date of Patent: Nov. 22, 1994

[54] HOCKEY PUCK

[75] Inventors: William Salcer; I. Martin Spier, both of New York, N.Y.

[73] Assignee: Loraney Sports, Inc., New York, N.Y.

[21] Appl. No.: 163,478

[22] Filed: Dec. 6, 1993

[51] Int. Cl.[5] ..... A63B 71/00

[52] U.S. Cl. ..... 273/128 R

[58] Field of Search ..... 273/126 R, 126 A, 128 R, 273/128 A, 128 CS

[56] References Cited

U.S. PATENT DOCUMENTS

| | | | |
|---|---|---|---|
| 4,111,419 | 9/1978 | Pellegrino | 273/128 R X |
| 4,801,144 | 1/1989 | DeMasi, Jr. et al. | 273/128 R |
| 5,275,410 | 1/1994 | Bellehumeur et al. | 273/128 R |
| 5,288,072 | 2/1994 | Hsieh | 273/128 R |

*Primary Examiner*—V. Millin
*Assistant Examiner*—Raleigh W. Chiu
*Attorney, Agent, or Firm*—Rodman & Rodman

[57] ABSTRACT

The hockey puck has a main body portion with opposite parallel surfaces. Ground engaging runners project from each of the opposite base portions of the puck and thus elevate the base surfaces of the puck from the ground to minimize surface contact between the puck and the ground. The ground engaging projections are equally spaced in a circular array at a rim portion of the puck. Openings in the puck concentrate weight at the center and periphery of the puck. The ground engaging projections and the main body portion are formed of different plastic materials, with each plastic selected for the most desirable physical properties and performance characteristics. Thus the ground engaging runners are relatively wear resistant with low ground friction whereas the main body portion is of relatively low hardness and provides the requisite stability and weight to the puck. The puck is formed as a composite of an inner spider mold that forms the ground engaging projections and an overmolded portion that constitutes the main body.

22 Claims, 3 Drawing Sheets

HOCKEY PUCK

BACKGROUND OF THE INVENTION

This invention pertains to hockey pucks, and more particularly to a hockey puck that is suitable for playing roller hockey and street hockey, indoors or outdoors.

As used herein, the term roller hockey is intended to refer to both roller hockey and street hockey, and both indoor and outdoor hockey activity.

A well-known problem encountered in roller hockey is the limited range of sliding movement of the puck on the ground due to relatively high frictional drag between the puck and the ground surface. Hockey pucks which make full surface contact with the ground such as shown in U.S. Pat. Nos. 3,887,188; 4,754,973 and 4,878,668 are often made of light-weight material to reduce frictional drag. However, light-weight pucks usually have a limited range of sliding movement due to low momentum. Light-weight pucks, when launched from the ground by a hockey stick, have a tendency to travel along an unpredictable path and may suddenly ascend in a "frisbee effect" or may suddenly descend, making it difficult to anticipate the course of the puck. Low momentum problems and unpredictable trajectories may also be characteristic of the hollow, resilient puck of U.S. Pat. No. 3,675,928.

U.S. Pat. Nos. 3,784,204 and 2,727,744 attempt to deal with limited slidability of the puck on the ground by providing spherical rollers in each face of the puck. In the more recent U.S. Pat. Nos. 4,793,769 and 4,801,144, revolvable balls are sized to project from opposite faces of the puck.

The operation of revolvable balls or spherical rollers in a puck can seize up entirely or be inhibited if dirt or debris becomes trapped in the roller sockets. Since dirt and debris are generally inescapable on ground surfaces, the malfunctioning of one or more rollers in a puck because of dirt and debris can result in inconsistent or unpredictable movement of the puck during a hockey game. Thus it may be necessary to either clean or replace the puck, and possibly interrupt the flow of action when continuity of play should otherwise be maintained.

U.S. Pat. No. 4,111,419 shows a hockey puck with pin heads and screw heads projecting from all surfaces of the puck including the circular periphery. Stress concentrations that result upon impact of a hockey stick surface with the pin heads or screw heads in the puck can promote deterioration or breakage of the hockey stick.

U.S. Pat. Nos. 3,726,526; 3,997,164; 4,078,801 and 4,153,253 show hockey pucks with recessed areas beyond the central surface portion of the puck. Such pucks are likely to wobble or tip onto an edge when struck which can lead to unforeseeable rolling movement of the puck.

A roller hockey puck manufactured by Sport Court Inc. of Salt Lake City, Utah, and sold under the trademark Speed Puck TM, includes an outer rim portion, a recessed central hub portion and three equally spaced arcuate openings between the rim portion and the central hub portion. Three arm portions that separate the arcuate openings join the rim portion to the central hub portion. Six axially directed plastic screw members with circular heads are pressed into six equally spaced openings in the rim portion such that the circular heads project from the opposite sides of the rim. The circular heads, which engage the ground, are oriented to align with the arcuate slots and do not align with the arm portions.

The arcuate slots of the Speed Puck TM have a radial extent of approximately 100°. Thus, a hockey stick impact force on the rim of the puck that is directed through a mid portion of the arcuate slot tends to substantially deflect the rim portion. Substantial deflection of the rim provides a relatively soft stick reaction to a hockey player. An impact force on the rim that is directed through the arm portion causes less deflection of the rim since the rim is supported by the arm portion. Low deflection of the rim provides a relatively hard stick reaction to a hockey player.

As a consequence of the different deflection of the puck rim depending upon where the puck is impacted, there will be different speed responses of the puck such as a relatively slow speed response when the puck is impacted through the arcuate slot and a relatively fast speed response when the puck is impacted through the arm portion. Since the Speed Puck TM responds differently to impact forces that pass through the middle of the arcuate slots as compared with impact forces that pass through the arm portions of the puck, use of such pucks can be bewildering to a hockey player.

It should also be noted that the Speed Puck TM is comprised of at least thirteen individual parts. Moreover, one or more of the twelve individual plastic screw members of the Speed Puck TM can gradually withdraw from or completely dislodge from the rim portion of the puck resulting in problems of weight imbalance, uneven friction forces around the puck, and puck performance that can be erratic and unpredictable.

Furthermore, if any part of a puck detaches or breaks away from the puck and a player accidentally skates over the broken or detached puck fragment, a loss of skate control can result causing injury to a player or players. Thus repair or replacement of the Speed Puck TM is required, thereby interrupting the continuity of play during a hockey game.

It is thus desirable to provide a hockey puck that has minimal surface contact with the ground for reduced frictional drag, has no moving rollers that can malfunction because of dirt or debris, has a desirable weight for roller hockey, and has no removable parts that can loosen or fall out during a hockey game.

OBJECTS AND SUMMARY OF THE INVENTION

Among the several objects of the invention are a novel hockey puck, a novel hockey puck for roller hockey a novel roller hockey puck having molded ground engaging projections that are non-removable and non-movable relative to the puck, a novel roller hockey puck with ground engaging projections that provide relatively minimal surface contact with the ground, a novel roller hockey puck that is entirely molded, and a novel method of minimizing surface contact and frictional drag of a hockey puck with the ground.

Other objects and features of the invention will be in part apparent and in part pointed out hereinafter.

In accordance with the invention, the hockey puck includes a disk shaped main body portion having opposite parallel surfaces and a generally circular periphery. A plurality of ground engaging projections extend from each of the parallel surfaces in a circular array. The ground engaging projections in one of the parallel surfaces align with the corresponding respective ground engaging projections in the opposite parallel surface. A plurality of openings offset from the ground engaging projections extend through the disk shaped body from one of the parallel surfaces to the other parallel surface.

The main body portion of the puck and the ground engaging projections are formed of different plastic materials having different physical properties and different performance characteristics. Thus the ground engaging projections are formed of relatively wear-resistant material with a relatively low ground friction and relatively high impact strength, whereas the main body portion need not be formed of a wear-resistant material since it is less subject to frictional wear than the ground engaging projections.

The puck is preferably formed as a composite of two molded structures. One of the molded structures is an inner spider mold that forms the ground engaging projections. The other molded structure is an overmolded main body portion which substantially encapsulates the spider mold except for the ground engaging portions of the spider mold.

The invention is also directed to a method of minimizing surface contact and frictional drag of a hockey puck with the ground by forming the puck with ground engaging runner portions that elevate the opposite base surfaces of the puck from the ground.

The invention accordingly comprises the constructions and method hereinafter described, the scope of the invention being indicated in the claims.

DESCRIPTION OF THE DRAWINGS

In the accompanying drawings.

Corresponding reference characters indicate corresponding parts throughout the several views of the drawings.

DETAILED DESCRIPTION OF THE INVENTION

Figure 1:
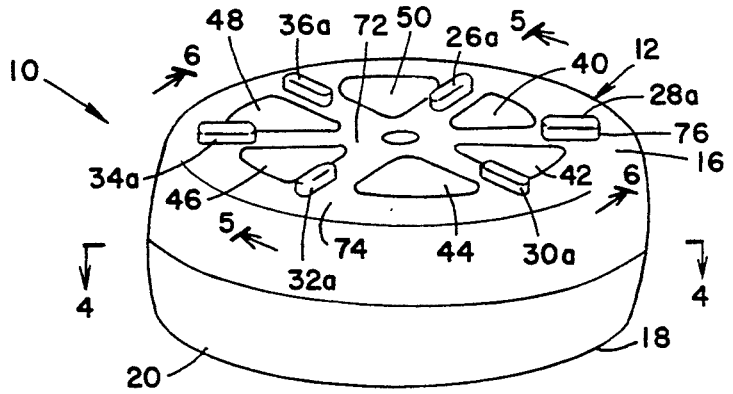
FIG. 1 is a simplified perspective view of a hockey puck incorporating one embodiment of the invention.

Referring to the drawings, a hockey puck incorporating one embodiment of the invention is generally indicated by the reference number 10 in FIG. 1.

The puck 10 includes a disk-shaped main body portion 12 having a central axis 14 (FIG. 3) and opposite parallel surfaces or bases 16 and 18. The main body 12 also includes a generally circular circumferential edge portion 20 bordering the parallel surfaces 16 and 18. The circumferential edge portion 20 is slightly curved in an axial direction as most clearly shown in FIG. 3, with a radius of 1–1½ inches, preferably 1 inches, to help prevent the puck from rolling on edge.

The main body portion 12 is preferably formed of a plastic material such as polyurethane, with a hardness range of approximately Shore A 85–95.

A plurality of ground engaging projections or runners 26*a*, 28*a*, 30*a*, 32*a*, 34*a* and 36*a*, are equally spaced, such as 60° apart, and project axially away from the surface 16. Similarly, a plurality of ground engaging runners 26*b*, 28*b*, 30*b*, 32*b*, 34*b* and 36*b* project axially away from the main body surface 18 and are axially aligned with the respective corresponding ground engaging runners of the surface 16.

The aligned runners 26*a*–26*b*, 28*a*–28*b*, 30*a*–30*b*, 32*a*–32*b*, 34*a*–34*b* and 36*a*–36*b* are preferably formed of a suitable wear-resistant, high impact strength, low friction coefficient plastic material such as nylon or a blend of nylon with Kevlar TM material in a combination for example of 17½% Kevlar TM by weight. Other suitable wear resistant, low friction coefficient materials can also be used.

Six equally spaced openings 40, 42, 44, 46, 48 and 50 are formed in the main body portion 12 and extend through the opposite surfaces 16 and 18. The openings 40–50 define spoke portions 60, 62, 64, 66, 68 and 70 in the main body 12, a central hub portion 72 and a rim portion 74.

The distribution of the six equally spaced openings 40–50 and the spoke portions 60–70 around the puck between the hub portion 72 and the rim portion 74 ensure that there is substantially consistent feel for impacts to the puck at any peripheral portion of the puck. Thus no matter where the puck is impacted, the "feel" of such impact through the hockey stick is substantially uniform, and the puck can respond in substantially uniform manner regardless of where it is impacted.

The puck dimensions are preferably an outside diameter of approximately 3 inches, and a thickness from the surface 16 to the surface 18 of approximately ⅞ inch. The ground engaging runners such as 26*a*–26*b* are elongated in the direction of the spoke portions with an elongated length of approximately 7/16 inch, a thickness of approximately 3/16 inch, and a projection height of approximately 3/32 inch from the surfaces 16 and 18. The ground engaging runners also have rounded corners and edges.

Figure 3:
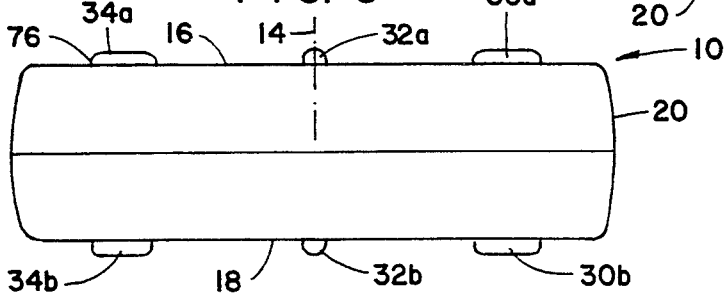
FIG. 3 is an elevational view thereof.
Figure 4:
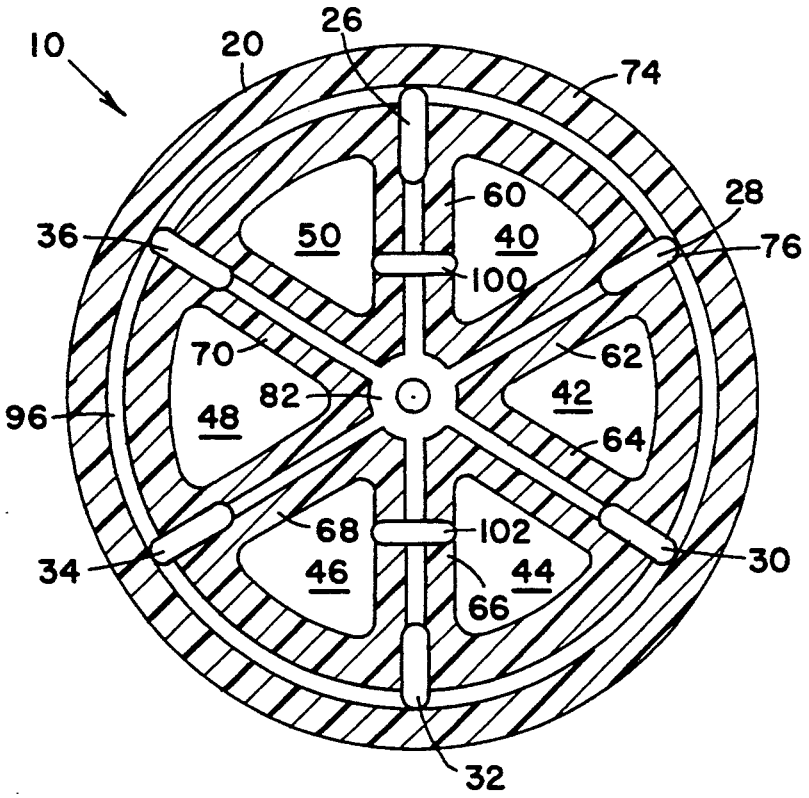
FIG. 4 is a sectional view taken on the line 4—4 of FIG. 1.

Preferably all of the ground runners 26*a*–*b* to 36*a*–*b* are beveled at the radially outermost end at an angle of 15° to 60°, and most preferably 40° as shown for example, at the runner 30*a* in FIG. 3. The bevel angle begins at approximately 0.010 inches from the base surface 16 of the puck and extends approximately 3/16 inch toward the puck axis 14. The purpose of the beveled runners is to facilitate the slidability of the puck over cracks or crevices in the ground surface.

Preferably the hub portion 72 is approximately ¾ inch in diameter. The thickness of the rim portion 74, in plan view, is approximately ½ inch, and the thickness of the spoke portions 60–70, in plan view, is approximately 5/16 to 3/8 inch. The distance between the radial extremity 76 of the runners 26*a*–26*b* to 36*a*–36*b* and the circumferential surface 20 is approximately ¼ inch.

Figure 5:
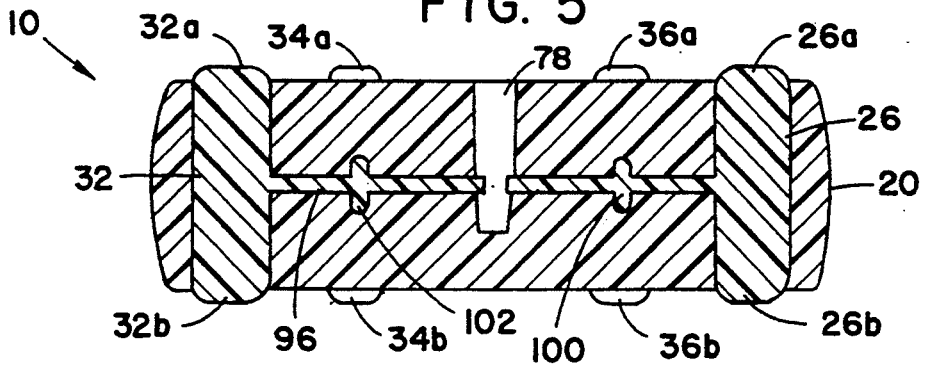
FIG. 5 is a sectional view taken on the line 5—5 of FIG. 1.
Figure 6:
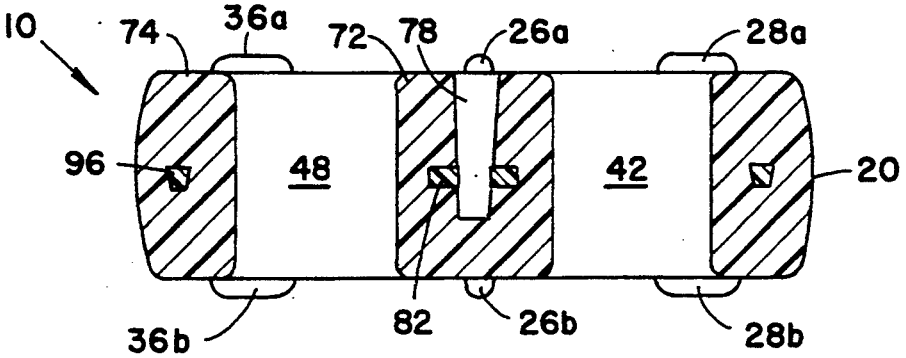
FIG. 6 is a sectional view taken on the line 6—6 of FIG. 1.
Figure 7:
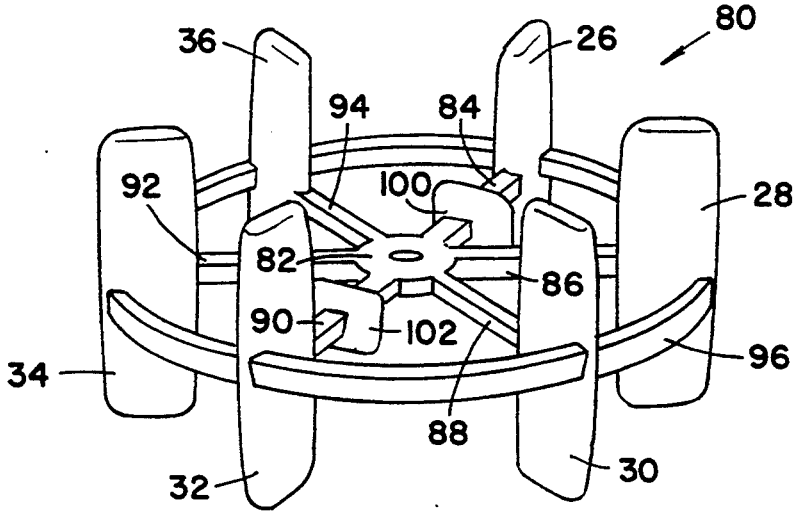
FIG. 7 is a simplified perspective view of a spider mold insert incorporated in the hockey puck.
Figure 8:
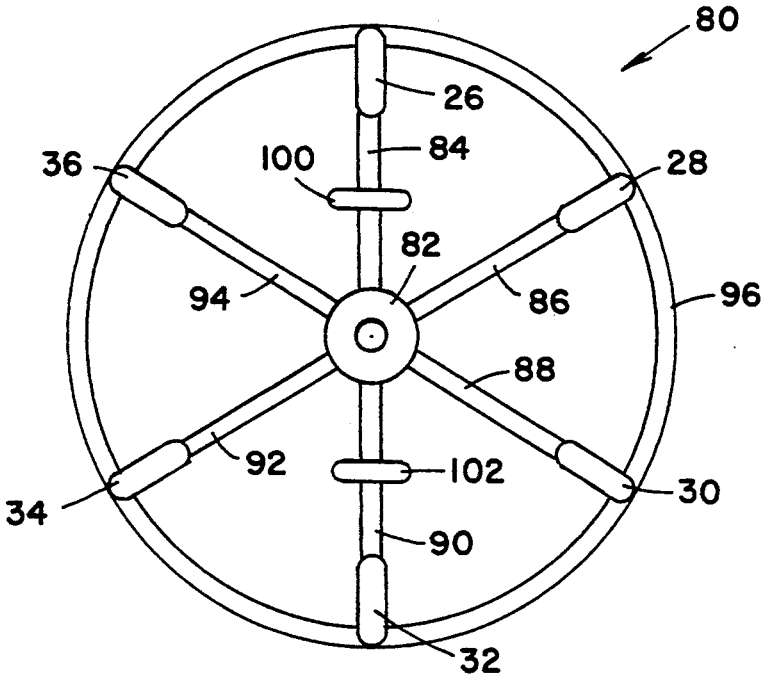
FIG. 8 is a top plan view thereof.
Figure 9:
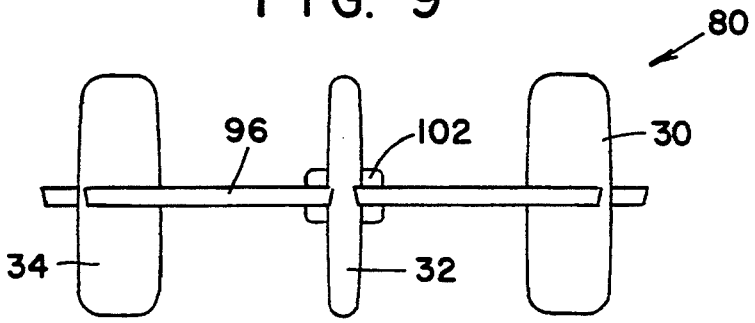
FIG. 9 is an elevational view thereof.

The puck 10 is preferably formed as a composite of two molded structures, the first of which is a molded inner structure or spider mold portion 80 as shown in FIG. 7 and an overmolded portion that forms the main body 12. A sprue opening 78 in the main body portion 12, as shown in FIGS. 5 and 6, is subsequently filled in accordance with known techniques to form the finished puck 10. As a further option, the sprue hole 78 can be left open if desired.

The spider mold portion 80 which is made in accordance with known molding techniques, includes a .central hub portion 82 with radial arm portions 84, 86, 88, 90, 92 and 94. The arm portions 84–94 terminate in axially directed blade portions 26, 28, 30, 32, 34 and 36. Opposite end portions of the blades 26–36 constitute the respective ground engaging runners **26*a*–26*b*, 28*a*–28*b*, 30*a*–30*b*, 32*a*–32*b*, 34*a*–34*b* and 36*a*–36*b*. A circular rim portion 96 joins the blades 26–36. Locating flanges 100 and 102 are formed on the radial arms 84 and 90 to facilitate alignment of the spider mold portion 80 in an overmold (not shown) that forms the main body 12**.

The spider mold portion 80 is placed in an overmold (not shown) to substantially encapsulate the spider mold portion 80. The openings 40–50 control weight and permit a desirable weight distribution of the main body 12. The openings 40–50 also assure symmetrical and relatively quick cooling of the overmolded main body portion 12 with uniform shrinkage. Overmolding of the spider mold portion 80 to produce the shape of the main body portion 12 is in accordance with known molding techniques. Preferably the total weight of the puck 10 is approximately 3.5 to 4 ounces.

In using the hockey puck 10, the runners **26*a*–26*b*, 28*a*–28*b*, 30*a*–30*b*, 32*a*–32*b*, 34*a*–34*b* and 36*a*–36*b* are the only portions of the puck which engage the ground during sliding movement of the puck. The reduced surface contact between the puck and the ground because of the runners 26*a*–26*b*, 28*a*–28*b*, 28*b*, 30*a*–30*b*, 32*a*–32*b*, 34*a*–34*b* and 36*a*–36*b* enhances the slidable range of the puck. The material which constitutes the runners 26*a*–26*b*, 28*a*–28*b*, 30*a*–30*b*, 32*a*–32*b*, 34*a*–34*b* and 36*a*–36*b* is sufficiently hard and wear resistant to maintain a desirable elevation of the puck surfaces 16 and 18 from the ground surface throughout the duration of an average roller hockey game. Rounded edges, corner radii and beveling of the runners 26*a*–26*b* to 36*a*–36*b* also promotes slidability of the puck 10** on the ground.

Figure 2B:
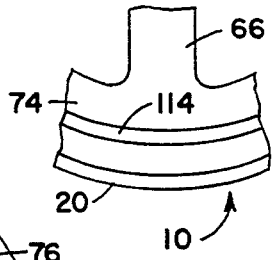
FIGS. 2A, 2B and 2C are fragmentary plan views that correspond to FIG. 2 showing alternate forms of runners for the Hockey Puck.
Figure 2:
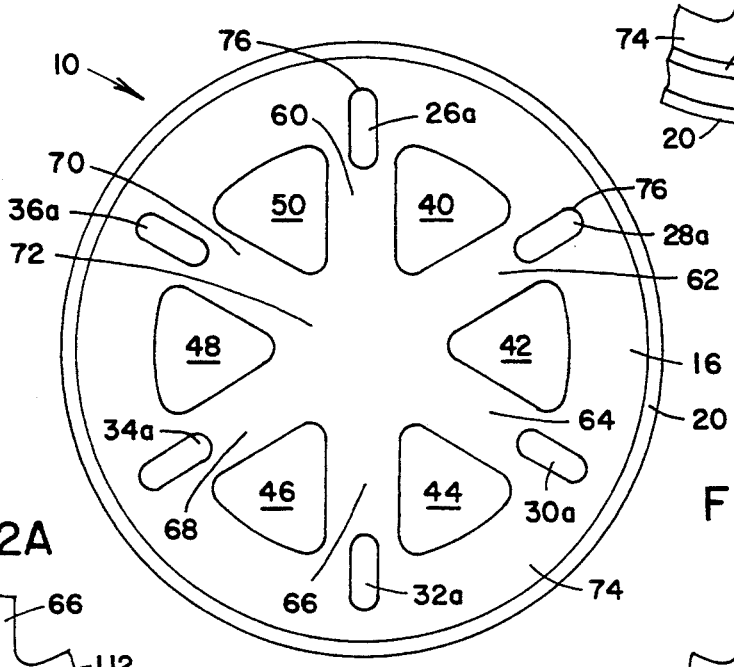
FIG. 2 is an enlarged plan view thereof.
Figure 2A:
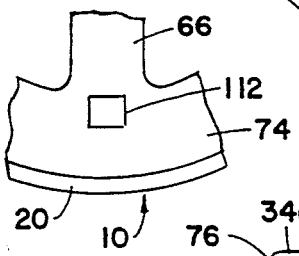
Figure 2C:
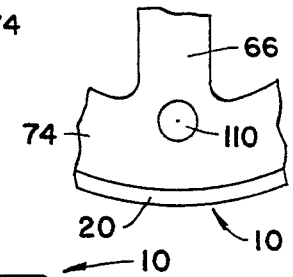

If desired, the runners can be of round, square or any other suitable geometric shape such as shown at the reference numbers 110 and 112 in FIGS. 2A and 2C. The primary purpose of the runners is to reduce the contact area between the puck and the ground.

The puck 10 is thus free of any moving or revolving parts that are likely to malfunction due to dirt or debris entrapment. The puck 10 is also free of any individual screw members which can withdraw or disengage. The permanent encasement of immovable, ground engaging runners helps ensure reliable and predictable puck performance. By eliminating any possibility Qf malfunction of the puck 10, the game of roller hockey can be played as a game of skill rather than a game of luck.

In another embodiment of the invention, the runners **26*a*–26*b* to 36*a*–36*b* are replaced by a single circumferential runner such as 114, shown in FIG. 2B and projecting from the opposite bases 16 and 18 of the puck. The runners 114 can be formed as continuations of the circular rim 96 of the spider mold 80**.

Some advantages of the present invention evident from the foregoing description include a roller hockey puck that is entirely molded and thus eliminates the need for manual assembly of the puck. Manufacture of the puck can be accomplished by conventional automated mass production techniques. The puck has an enhanced sliding range in comparison with a full surface contact puck due to the limited surface contact of the ground engaging runners. The ,outer material of the puck is relatively soft and thus less prone to cause injury than pucks of harder material. In addition, the puck is durable and capable of substantially consistent performance because there are no moving parts of the puck and no removable parts which are likely to malfunction, break or detach during the course of a roller hockey game. Thus the present puck will have a longer and safer game life than multi-piece pucks since the present puck is integrally formed and is unlikely to suffer broken or detached parts.

A further advantage is that the openings in the puck have a relatively small angular extent of 50° or less Therefore, whether an impact is directed through the opening or through the spokes, the puck speed response is substantially consistent, no matter where it is hit.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. A hockey puck comprising a) a molded inner structure formed of a first plastic material, b) a disk-shaped main body formed of a second plastic material and molded over said molded inner structure, said main body having a central axis, a circular periphery surrounding said central axis and opposite parallel surfaces generally perpendicular to said central axis, c) said molded inner structure having a plurality of ground-engaging projections extending axially from each of said opposite parallel surfaces, each of said ground engaging projections being joined together within said main body such that the molded inner structure including the ground engaging projections forms a single molded unit and the ground engaging projections are non-movable with respect to said main body and non-removable from said main body.

2. The hockey puck as claimed in claim 1 wherein said projections are equally spaced around said central axis.

3. The hockey puck as claimed in claim 1 including six of said projections spaced 60° apart.

4. The hockey puck as claimed in claim 1 wherein said projections are elongated in a radial direction with respect to the central axis.

5. The hockey puck as claimed in claim 1 wherein said projections are of circular shape in cross-section.

6. The hockey puck as claimed in claim 1 wherein said projections are of square shape in cross-section.

7. The hockey puck as claimed in claim 1 wherein said projections have an elevation of approximately 3/32 inch from said parallel surfaces.

8. The hockey puck as claimed in claim 1 wherein said main body is formed with a plurality of openings equally spaced around said central axis and extending through said disk from one of the parallel surfaces to the other said parallel surface.

9. The hockey puck as claimed in claim 8 wherein said openings define a central hub portion of said main body, a rim portion spaced from said central hub portion, and equally-spaced spoke portions that join said central hub portion to said rim portion.

10. The hockey puck as claimed in claim 9 wherein said ground engaging projections are aligned with said spoke portions.

11. The hockey puck as claimed in claim 8 wherein said openings and said ground engaging projections are offset from each other in alternating sequence on said puck with respect to said central axis.

12. The hockey puck as claimed in claim 8 wherein said openings are three-sided.

13. The hockey puck as claimed in claim 1 wherein each of said ground engaging projections extend in an axial direction continuously through said disk-shaped main body beyond the opposite parallel surfaces of said body.

14. The hockey puck as claimed in claim 1 wherein said molded inner structure interconnects said ground engaging projections at 60° intervals around said central axis.

15. The hockey puck as claimed in claim 1 wherein said molded inner structure has a central axis and a rim portion and said projections are at said rim portion.

16. The hockey puck as claimed in claim 1 wherein said ground engaging projections have a radially outermost end that is beveled at a predetermined angle.

17. The hockey puck as claimed in claim 16 wherein the bevel angle is in the range of 15° to 60°.

18. The hockey puck as claimed in claim 16 wherein said bevel angle is approximately 40° and begins at approximately 0.010 inches from said opposite parallel surfaces.

19. A hockey puck as claimed in claim 1 wherein said molded inner structure is a spider structure having said ground engaging projections spaced around said central axis.

20. A method of minimizing frictional drag of a hockey puck with the ground comprising, a) molding an inner spider structure having ground engaging projections equally spaced around a central axis of the inner mold along a circular periphery of the inner spider structure, b) forming the ground engaging projections with an axial elongation in a direction parallel to the central axis of the inner spider structure, and c) forming an overmold over the inner spider structure to substantially incorporate the spider structure with the overmold being disk shaped and having a central axis that substantially aligns with the central axis of the inner spider structure and opposite parallel surfaces that are spaced apart an amount which permits the ground engaging projections to project from the opposite parallel surfaces.

21. The method as claimed in claim 20 including providing spoke portions in the overmold and aligning the ground-engaging projections with the spoke portions.

22. The method as claimed in claim 20 including alternating the ground engaging projections and spoke portions with openings in the overmold.

* * * * *